US005088374A

United States Patent [19]

Saijo

[11] Patent Number: 5,088,374

[45] Date of Patent: Feb. 18, 1992

[54] TREMOLO DEVICE FOR A GUITAR

[75] Inventor: Yatsuse Saijo, Tokyo, Japan

[73] Assignee: Fernandes Co., Ltd., Tokyo, Japan

[21] Appl. No.: 658,525

[22] Filed: Feb. 21, 1991

[30] Foreign Application Priority Data

Feb. 26, 1990 [JP] Japan ..... 2-42357

[51] Int. Cl.[5] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 2,741,146 | 4/1956 | Fender | 84/313 |
| 4,555,970 | 12/1985 | Rose | 84/313 |
| 4,811,646 | 3/1989 | Hoshino | 84/313 |
| 4,892,025 | 1/1989 | Steinberger | 84/313 |
| 4,903,568 | 2/1990 | Itoh | 84/313 |
| 4,939,971 | 7/1990 | Satoh | 84/313 |

*Primary Examiner*—Brian W. Brown

*Attorney, Agent, or Firm*—Finnegan, Henderson, Farabow, Garrett & Dunner

[57] ABSTRACT

A tremolo device for a guitar includes a flat plate pivotably mounted relative to a guitar body, another plate secured on an under surface of the flat plate, a first fulcrum part of the flat plate for a pivotting thereof to lower a tone of the guitar, a second fulcrum part of another plate for a pivotting thereof to raise the tone of the guitar, and screws fitted to the guitar body and in contact with both fulcrum parts. When a tremolo arm is inactivated, the plates come into contact with the screws at both the first fulcrum part and the second fulcrum part, and when activating the tremolo arm, either one plate or another plate comes into contact with the screws and is rotated about either of the fulcrum parts.

6 Claims, 5 Drawing Sheets

TREMOLO DEVICE FOR A GUITAR

BACKGROUND OF THE INVENTION

1. Field of the Invention

The present invention relates to a tremolo device for a guitar, and more particularly, it relates to a device enabling a precise return to an initial tuning of the strings of the guitar after the tremolo device has been used.

2. Description of the Related Art

A guitar, for example, an electric guitar, equipped with a tremolo device which is manually moved to produce a tremolo effect on musical tones obtained by, for example, plucking the strings, is well-known and widely used. Known conventional tremolo devices include a synchronized device fitted to guitars made by the Fender Company, a "Bigsby" device fitted to guitars made by the Gibson Company, and a "Vibramute" device fitted to guitars made by the Mosrite Company, and these tremolo devices have basically similar constructions.

Namely, these devices are provided with springs having a tension almost the same as the total tension of the strings of the guitar, and while an equilibrium is maintained between the tension of the springs and the total tension of the strings, the tones of the strings of the guitar are raised or lowered by moving a rod member, i.e., a tremolo arm, upward and downward in relation to a guitar body, to thus rotate the tremolo device about one fulcrum on the guitar body and thereby vary the tension of the guitar strings.

In the conventional tremolo devices mentioned above, however, a problem arises in that the whole of the device is always in a "floating" condition around one fulcrum, while maintaining an equilibrium between the tension of the springs and the tension of the strings.

In an ideal tremolo device, after the force applied to the tremolo arm is released, the tones raised or lowered by the device are returned to the exact initial tuning of the strings of the guitar, in which the equilibrium between the tension of the springs and the total tension of the strings is maintained. In practice, however, since the whole device is in a floating condition as mentioned above, deviations in the tones may occur which cannot be compensated by the restoring force derived from the tensions of the springs or strings, and thus the guitar will be out of tune when returned to the normal condition, i.e., when the tremolo device is inactivated.

U.S. Pat. No. 4,903,568, discloses a tremolo device for a guitar, by which the above-mentioned problem is solved. This device is provided with a stabilizing mechanism comprising a stabilizing plate and a roller abutting the plate, and enables a return to an exact initial tuning after the device has been activated. An effect can be obtained according to this mechanism, of the same manipulating feeling as that of the afore-mentioned "floating" type of device, but the construction thereof is complicated, an adjustment of the stabilizing plate for the initial tuning position is troublesome, and the manufacturing cost is high.

U.S. Pat. No. 4,939,971, also discloses a tremolo device. This device has two fulcrums; one for raising the tone of guitar and one for lowering the same independently, and by presetting a tension of springs to a tension higher than that of the strings, a part of the tremolo device will come into contact with the guitar body. According to this construction, after the tremolo device has been used or when the tremolo device is inactivated, the exact initial tuning can be recovered, since the device comes into contact with the guitar body. Nevertheless, since the device does not have a floating construction, click-shocks will be produced when continuously manipulating the tremolo arm from the downward position to the upward position or vice-versa, and thus a smooth manipulation of the tremolo arm cannot be accomplished. Furthermore, due to the click-shock, it becomes difficult to play the guitar while finely oscillating the tremolo arm, i.e., to use a "tremolo playing technique".

SUMMARY OF THE INVENTION

An object of the present invention is to solve the above-mentioned problem by providing a tremolo device for a guitar by which it is possible to return to the exact initial tuning of strings of the guitar after using the tremolo device.

The above object is achieved, according to the present invention, by providing a tremolo device for a guitar comprising:

(1) base plate means pivotably mounted relative to a guitar body, said base plate means including a flat plate and a bar secured on an underside of said flat plate, said bar extending downward from said flat plate into a recess provided in said guitar body and adapted for receiving and anchoring strings of said guitar;

(2) spring means for urging said base plate means in one direction of rotation opposite to a rotating force applied to said base plate means in another direction of rotation due to a tension of said guitar strings;

(3) a tremolo arm secured to said base plate means and manipulated by a guitarist to thereby pivot said base plate means and thus vary a tension applied to said strings, whereby a tremolo effect is produced;

(4) a first fulcrum part provided in said base plate means for allowing a pivotal movement of said base plate means by which a tone of said guitar is lowered;

(5) a second fulcrum part provided in said base plate means, independently of said first fulcrum part, for allowing a pivotal movement of said base plate means by which a tone of said is guitar is raised; and (6) receiving means provided on said guitar body and able to come into contact with said first fulcrum part and said second fulcrum part, to thereby provide two fulcrums around which said base plate means can be pivotted.

In the present invention, the base plate means comes into contact with the receiving means at both the first fulcrum part and the second fulcrum part when the tremolo arm is inactivated.

Further, the base plate means comes into contact with the receiving means at only the first fulcrum part when the second fulcrum part is separated from the receiving means, when the tremolo arm is activated in such a manner that the base plate means is rotated in one direction of rotation over a stable position in which both fulcrums are in contact with said receiving means, and conversely, the base plate means comes into contact with the receiving means at only the second fulcrum part when the first fulcrum part is separated from the receiving means, when the tremolo arm is activated in such a manner that the base plate means is rotated in another direction of rotation over the stable position.

DESCRIPTION OF THE PREFERRED EMBODIMENTS

Figure 1:
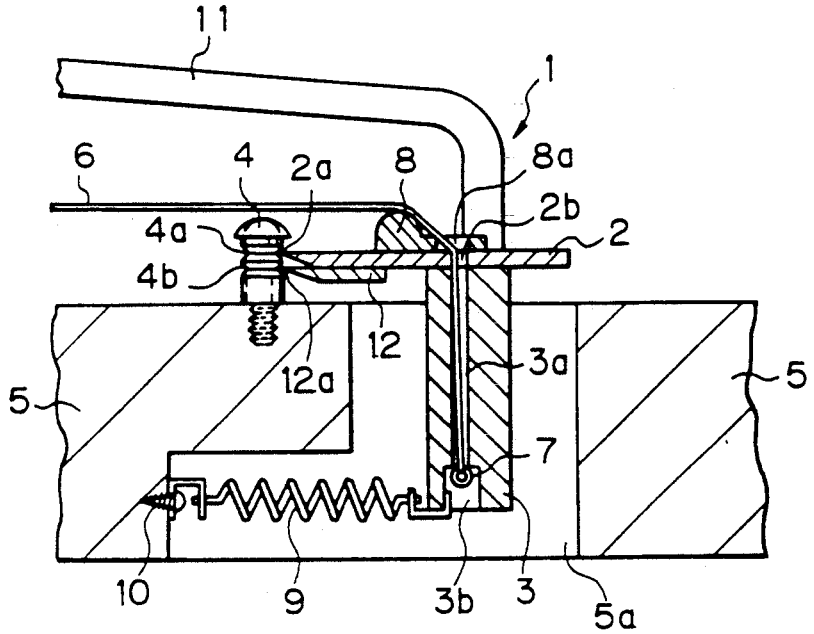
FIG. 1 is a partial longitudinal view of a guitar, showing a tremolo device in an inactivated condition according to a first embodiment of the present invention, and taken along the lines I—I of FIG. 2.
Figure 2:
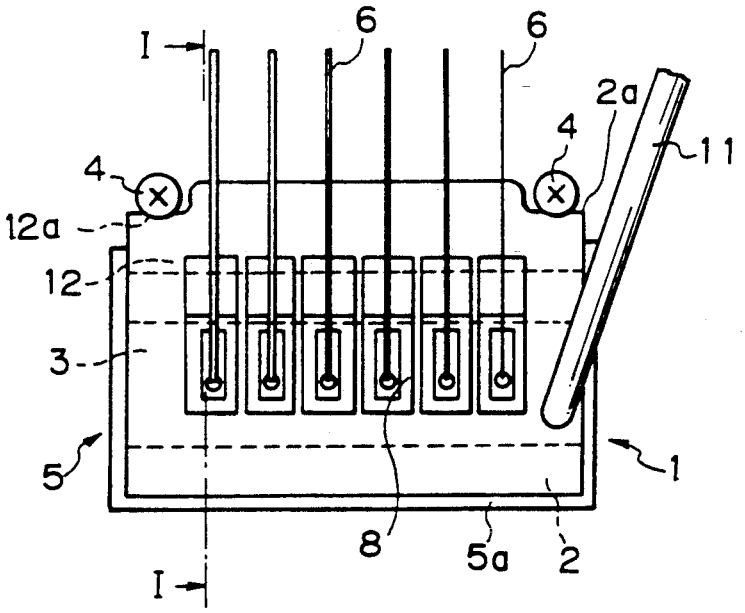
FIG. 2 is a plan view of a tremolo device according to the first embodiment of the invention.
Figure 3:
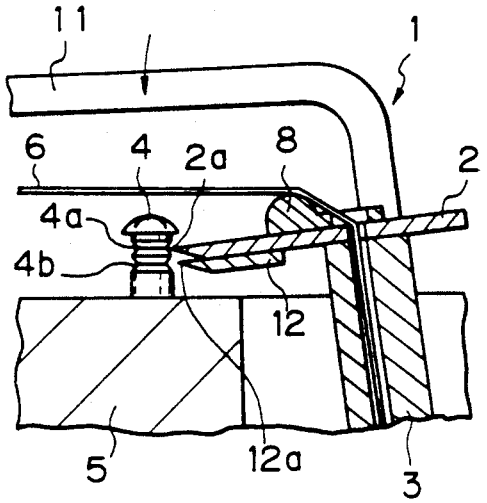
FIG. 3 is a longitudinal view similar to FIG. 1, in which the tremolo device is activated to lower the tones of the strings of the guitar.

Referring to FIGS. 1 to 3, reference numeral 1 designates a tremolo device for a guitar in accordance with the first embodiment of the present invention. As shown in FIG. 1, the tremolo device 1 includes a flat plate 2 and a bar 3 secured to an under surface of the plate 2.

A front end of the flat plate 2 is provided with a knife-edge shape, to thereby provide a first fulcrum part 2*a* which comes into contact with a plurality of screws 4 as the receiving means of the invention. Each screw 4 is screwed into a guitar body 5 and provided with two V-shaped recesses 4*a* and 4*b* vertically spaced from each other.

In this arrangement, the above-mentioned first fulcrum part 2*a* comes into contact with the upper V-shaped recess 4*a* of each screw 4, to provide a first fulcrum about which the flat plate 2 is pivotably mounted. The bar 3 extends downward into a recess 5*a* in the guitar body 5.

Reference numeral 6 designates strings of the guitar, the extremity of each string 6 being provided with an anchor element 7 seated in an elongated portion of a corresponding bore 3*a* formed in the bar 3. Each string 6 is then passed over a corresponding string saddle 8 through a corresponding hole 2*b* formed in the flat plate 2 and a corresponding through hole 8*a* provided in the string saddle 8, and the other extremity of each string 6 is fixed to a tuning peg in a guitar head, not shown in the figures.

The bar 3 is provided with recesses 3*b* at the lower extremity thereof, and a plurality of tension springs 9 are engaged at one end in the recesses 3*b*. The other ends of the tension springs 9 are connected to the guitar body 5 by screws 10 screwed therein. Note, the plurality of tension springs 9 may be replaced by one tension spring.

The tension springs 10 are provided to balance the flat plate 2 by urging same to rotate in a clockwise direction as seen in FIG. 1 opposite to a rotating force imposed thereon in a counter-clockwise direction of rotation and derived from the total tension of the strings 6.

Reference numeral 11 designates a tremolo arm. The tremolo arm 11 is screwed into the flat plate 2 and extends upwardly therefrom, and is manipulated by a guitarist to pivot the flat plate 2 and the bar 3 in both directions of rotation, to thereby vary the tension of the guitar strings 6, and thus produce a tremolo effect while raising or lowering the tone of the guitar strings.

In the above-described construction of the tremolo device 1, according to the first embodiment of the present invention, another flat plate 12 is secured on the under surface of the flat plate 2, as a constituent of base plate means of the invention. Similar to the first flat plate 2, a front end of the flat plate 12 also has a knife-edge shape to thereby provide a second fulcrum part 12*a*, which comes into contact with the lower V-shaped recess 4*b* of each screw 4 to provide a second fulcrum about which the flat plate 12 is pivotably mounted with the flat plate 2.

As shown in FIG. 1, in the normal mode where the tremolo arm 11 is inactivated, and where a normal and original tuning of the strings 6 should be recovered, the tension of the tension springs 9 is preset in such a manner that, in a stable "semi-floating" condition, the flat plates 2 and 12 come into contact with the V-shaped recesses 4*a* and 4*b* of the screws 4 at both the first fulcrum part 2*a* and the second fulcrum part 12*a*, respectively.

The operation of the above-mentioned tremolo device is as follows:

As mentioned before, to produce a tremolo effect while playing the guitar, the tremolo arm 11 is moved upward or downward in relation to the guitar body 5, in the same way as a conventional tremolo device. For example, when lowering the tone of the guitar, the guitarist activates the tremolo arm 11 downward toward the guitar body 5, as shown in FIG. 3.

In FIG. 3, the whole tremolo device 1 is rotated in the counter-clockwise direction about the first fulcrum part 2*a* providing the afore-mentioned first fulcrum, over the stable position of the flat plate 2 as shown in FIG. 1. Therefore, in this condition, the second fulcrum part 12*a* of the flat plate 12 is separated from the lower V-shaped recess 4*b* of each screw 4 and the tension of the strings 6 is reduced in comparison with the tension thereof in the condition shown in FIG. 1, to thereby lower the tone of the guitar.

Figure 4:
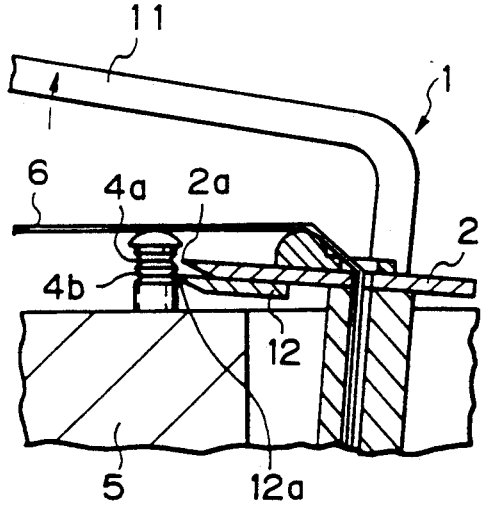
FIG. 4 is a longitudinal view similar to FIG. 1 in which the tremolo device is activated to raise the tones of the strings of the guitar.

When raising the tone of the guitar, the guitarist moves the tremolo arm 11 upward away from the guitar body 5, as shown in FIG. 4.

In FIG. 4, the whole tremolo device 1 is rotated in the clockwise direction about the second fulcrum part 12*a* providing the afore-mentioned second fulcrum, over the stable position of the flat plate 12 as shown in FIG. 1. In this condition, the first fulcrum part 2*a* of the flat plate 2 is separated from the upper V-shaped recess 4*a* of each screw 4 and the tension of the strings 6 is increased in comparison with the tension thereof in the condition shown in FIG. 1, to thereby raise the tone of the guitar.

When wishing to stop using the tremolo device 1 and to resume normal playing without the tremolo effect, the guitarist need only release the tremolo arm 11, whereby the tremolo device 1 is returned to the stable condition shown in FIG. 1 by the equilibrium of rotating forces derived from the tensions of the guitar strings 11 and the tension springs 9, and therefore, it is possible to return to the exact initial tuning.

In this way, according to this embodiment, since the flat plates 2 and 12 in the inactivated condition of the tremolo device 1 come into contact with the screws 4 at two fulcrum parts 2*a* and 12*a* in the stable "semi-floating" condition, the guitarist can move the tremolo arm 11 continuously from the downward position shown in FIG. 3 to the upward position shown in FIG. 4, or vice versa, without a feeling of click-shock when activating the tremolo device 1 to vibrate the tremolo arm 11 thereof.

FIGS. 5 to 8 show other embodiments of the present invention, including various modifications of the form of contact between the base plate means and the receiving means in the previous embodiment. Note, in these figures, elements similar to those of the first embodiment are indicated by the same reference numerals.

Figure 5:
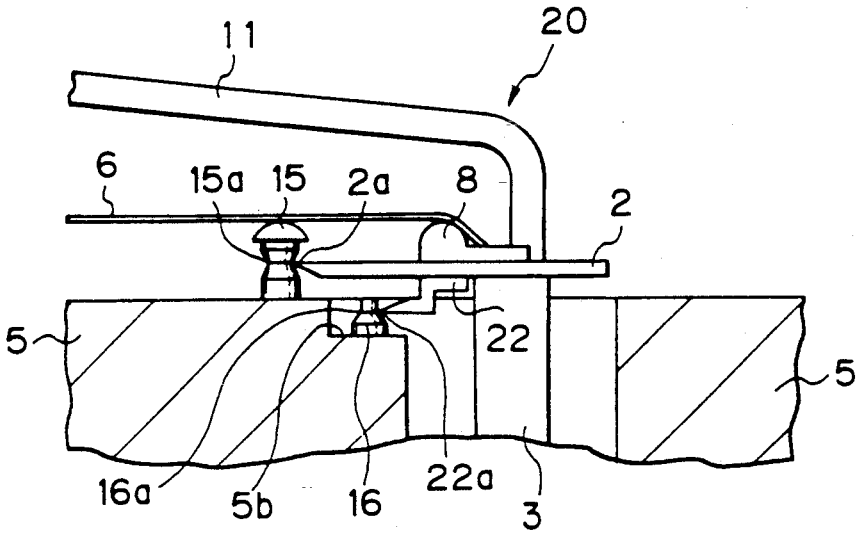
FIG. 5 is a partial longitudinal view of a guitar, showing a tremolo device in an inactivated condition according to a second embodiment of the present invention.

According to the second embodiment shown in FIG. 5, a plurality of screws 15 (only one screw shown in the figure) screwed into the guitar body 5 and a plurality of fulcrum members 16 mounted on a step part 5*b* of the guitar body 5, are provided as the receiving means of the tremolo device 20. Each screw 15 is provided with only one recess 15*a* into which the first fulcrum part 2*a* of the flat plate 2 is engaged.

As apparent from FIG. 5, each fulcrum member 16 is positioned on the guitar body 5 at a level different from that of the screws 15, and is provided with a recess 16*a* into which another plate 22 is engaged. Similar to the flat plate 12 in FIG. 1, the plate 22 is secured on the under surface of the flat plate 2, and a front end of the plate 22 has a knife-edge shape to thereby provide a second fulcrum part 22*a* which comes into contact with the recess 16*a*, to thereby provide a second fulcrum about which the plate 22 is pivotably mounted. The operation of this tremolo device 20 is substantially the same as that of the tremolo device 1 of the first embodiment.

Figure 6:
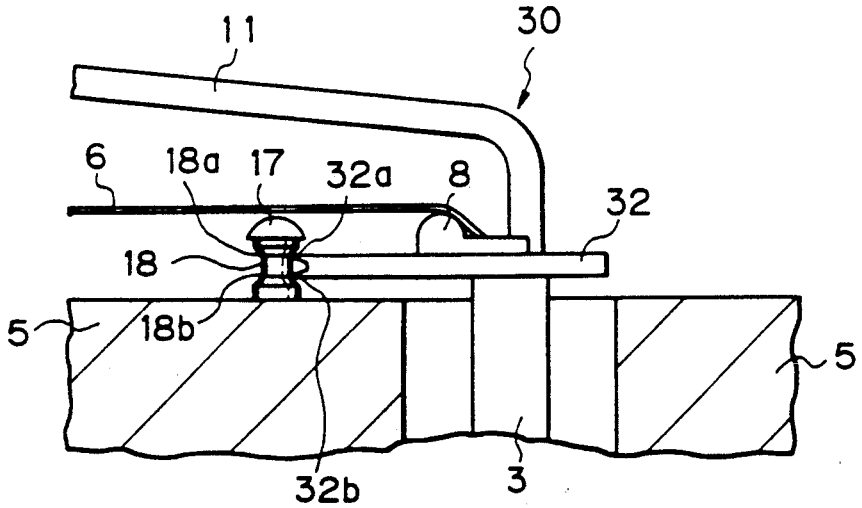
FIG. 6 is a partial longitudinal view of a guitar, showing a tremolo device in an inactivated condition according to a third embodiment of the present invention.

FIG. 6 shows the third embodiment of the present invention.

According to this embodiment, a front end of a flat plate 32 is formed to have a knife-edge shaped upper edge 32*a*, which corresponds to the first fulcrum part of base plate means, and a knife-edge shaped lower edge 32*b*, which corresponds to the second fulcrum part of base plate means of the invention. Further, as the receiving means of the invention, a plurality of screws 17, which are screwed into the guitar body 5 and positioned at a substantially same level on the guitar body 5 as each other, are provided.

Each screw 17 is provided with a recess 18 defined by two depressed edges 18*a* and 18*b*. In an inactivated condition of the tremolo device 30, the above-mentioned upper edge 32*a* comes into contact with the upper depressed edge 18*a* and the lower edge 32*b* comes into contact with the lower depressed edge 18*b*, to provide a stable "floating" bearing condition of the flat plate 32 on the screws 17.

The operation of this tremolo device 30 is also substantially the same as that of the tremolo device 1 of the first embodiment. Namely, when raising the tone of the guitar, the flat plate 32 is rotated in the clockwise direction about the lower edge 32*b* providing the afore-mentioned second fulcrum part of the invention, over the stable position of the flat plate 32 as shown in FIG. 6. In this condition, the upper edge 32*a* of the flat plate 32 is separated from the upper depressed edge 18*a* of each screw 17 and the tension of the strings 6 is increased in comparison with the tension thereof in the condition shown in FIG. 6, to thereby raise the tone of the guitar.

On the other hand, when lowering the tone of the guitar, the plate 32 of the tremolo device 30 is rotated in the counter-clockwise direction about the upper edge 32*a* providing the first fulcrum part of the invention. Therefore, in this condition, the lower edge 32*b* of the flat plate 32 is separated from the lower depressed edge 32*b* of each screw 17 and the tension of the strings 6 is reduced in comparison with the tension thereof in the condition shown in FIG. 6, to thereby lower the tone of the guitar.

Figure 7:
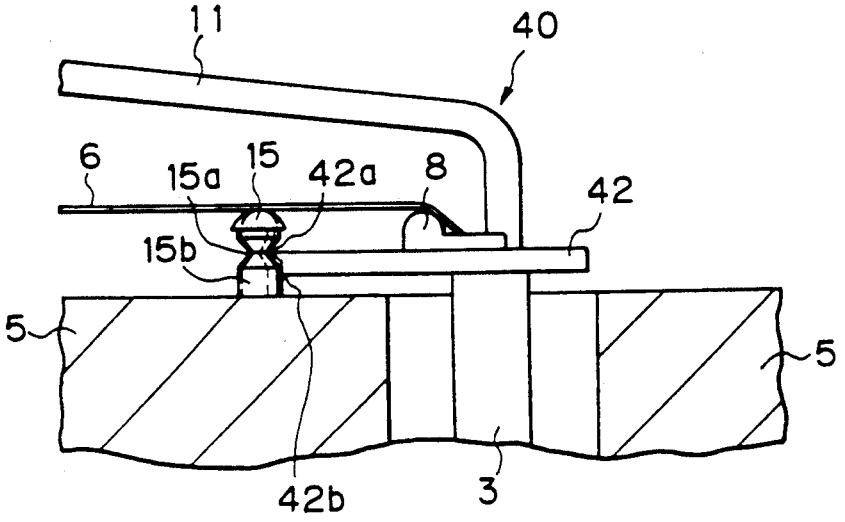
FIG. 7 is a partial longitudinal view of a guitar, showing a tremolo device in an inactivated condition according to a fourth embodiment of the present invention.

FIG. 7 shows the fourth embodiment of the present invention.

According to this embodiment, a front end of a flat plate 42 of the tremolo device 40 is formed to have a knife-edge shaped upper edge 42*a*, which corresponds to the first fulcrum part of the base plate means, and a sequestered lower edge 42*b*, which corresponds to the second fulcrum part of the base plate means of the invention. Further, as receiving means of the invention, a plurality of screws 15 substantially the same as those in the second embodiment shown in FIG. 5 are provided and each screw 15 has the recess 15*a* above a shaft part 15*b* thereof.

In an inactivated condition of the tremolo device 40, the above-mentioned upper edge 42*a* comes into contact with the recess 15*a* of each screw 15, to thereby provide a first fulcrum about which the plate 42 is rotated when lowering the tone of the guitar, and the other lower edge 42*b* comes into contact with the shaft part 15*b* of each screw 15, to thereby provide a second fulcrum about which the plate 42 is rotated when raising the tone of the guitar.

The operation of this tremolo device 40 is also substantially the same as that of the tremolo device 1 of the first embodiment. Namely, when lowering the tone of the guitar, the lower edge 42*b* is separated from the shaft parts 15*b* due to the pivoting of the plate 42 about the first fulcrum, and when raising the tone, the upper edge 42*a* is separated from the recesses 15*a* due to the pivoting of the plate 42 about the second fulcrum.

Figure 8:
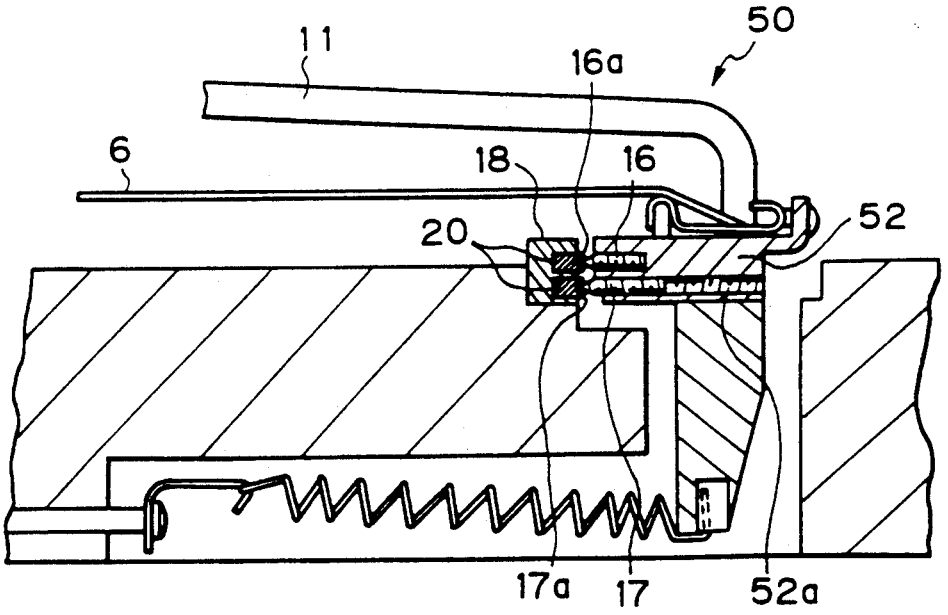
FIG. 8 is a partial longitudinal view of a guitar, showing a tremolo device in an inactivated condition according to a fifth embodiment of the present invention, and taken along the line VIII—VIII of FIG. 9.
Figure 9:
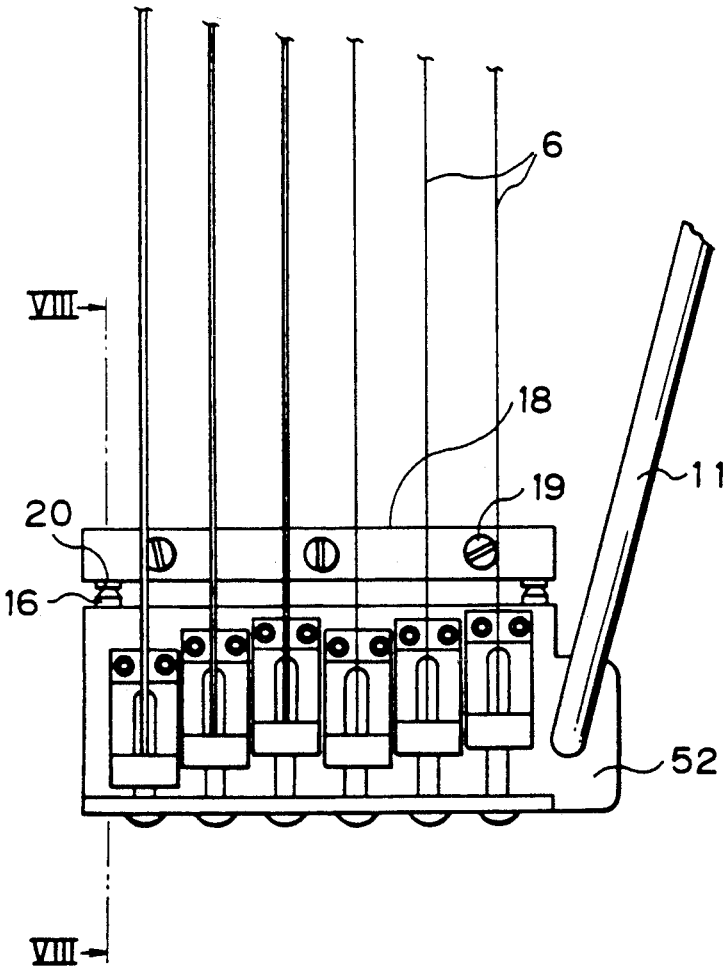
FIG. 9 is a plan view of the tremolo device according to the fifth embodiment of the present invention.

FIGS. 8 and 9 show the fifth embodiments of the present invention.

According to this embodiment, a flat plate 52 has at a front end thereof two upper pin-shaped members 16 providing the first fulcrum part 16*a* and two lower pin-shaped members 17 providing the second fulcrum part 17*a*. The upper members 16 are embedded in the plate 52. On the other hand, each lower member 17 is threadably engaged with a corresponding threaded-bore 52*a* extending from a rear end of the plate 52 to a front end thereof, which enables an adjustment of the protruding length of the member 17 from the front end.

As the receiving means of the present invention, a receiving member 18 is secured on the guitar body 5 by screws 19. Corresponding to each pin-shaped member 16 or 17, the receiving member 18 has four concave members 20 embedded in a side thereof facing the plate 52. In an inactivated condition of the tremolo device 50 shown in FIG. 8, each upper member 16 comes into contact with each concave member 20 positioned on an upper side in the figure, to provide the first fulcrum when lowering the tone of the guitar, and each lower member 17 comes into contact with each concave member 20 on a lower side to provide the second fulcrum when raising the tone of the guitar. The operation of this tremolo device 50 is also substantially the same as that of the previous devices.

According to this embodiment, by using the pin-shaped members 16 and 17 as the first and second fulcrum parts, the handling of the tremolo device 50 can be made smoother due to a lowered friction resistance. Furthermore, since the protruding length of the lower pin-shaped members 17 is adjustable, the normal tuning-position of the tremolo device 50 can be obtained more precisely by a finer adjustment of the length. In addition, the adjustable construction of the members 17 makes it possible to adjust an inclination angle of the plate 52 against a surface of the guitar body 5, whereby the movement of the tremolo arm 11 when activating the tremolo device 50 can be adjusted to either a mainly upward movement or a mainly downward movement, as required.

It will be understood by those skilled in the art that, beside the foregoing embodiments, various changes and modifications may be made to the present invention without departing from the spirit thereof. For example, although the receiving means in the embodiments comprises a plurality of screws screwed into the guitar body, the receiving means of the invention may be only one stick-type member mounted on the guitar body and extended thereon perpendicular to the guitar strings.

As mentioned hereinabove, according to the present invention, in the normal and original tuning condition of the tremolo device, both the first fulcrum part for lowering the tone of the guitar and the second fulcrum part for raising the tone thereof come into contact with the receiving means. Therefore, in the inactivated condition of the tremolo device, the base plate means can be supported in a more stable "semi-floating" condition than obtained in the conventional "floating" type of tremolo device, whereby the stability of the initial tuning can be remarkably improved.

Furthermore, when activating the tremolo arm, either the first fulcrum or the second fulcrum operates independently of the other, and thus, after activating the tremolo arm, both fulcrums operate together to thereby cause the base plate means to return exactly to the initial tuning position. Note, regarding the stability of the tremolo device, it will be understood that the longer the vertical distance between the first fulcrum and the second fulcrum, the greater the stability of the tremolo device. Therefore, in this case, even if the guitarist plays a specific string of the guitar with a "muting" or "choking" technique in the normal mode, the initial tuning of the other strings can be maintained.

Further, according to the present invention, this stability in the normal mode can be easily obtained by a simple change in shape of the conventional flat plate, without providing new elements such as a stabilizing plate in the prior art, whereby the manufacturing costs can be reduced.

I claim:

1. A tremolo device for a guitar comprising:

(1) base plate means pivotably mounted relative to a guitar body, said base plate means including a flat plate and a bar secured on an under surface of said flat plate, said bar extending downward from said flat plate into a guitar recess provided in said guitar body and being adapted to receive anchor strings of said guitar;

(2) spring means for urging said base plate means in one direction of rotation opposite to a rotating force applied to said base plate means in another direction of rotation due to a tension of said guitar strings;

(3) a tremolo arm secured to said base plate means and manipulated by a guitarist to pivot said base plate means to thereby vary a tension applied to said strings, whereby a tremolo effect is produced;

(4) a first fulcrum part provided in said base plate means for a pivotal movement thereof by which a tone of said guitar is lowered;

(5) a second fulcrum part provided in said base plate means independently of said first fulcrum part for a pivotal movement of said base plate means by which a tone of said guitar is raised;

(6) receiving means provided on said guitar body and contactable with said first fulcrum part and said second fulcrum part, to thereby provide two fulcrums about which said base plate means can be pivotted;

said base plate means coming into contact with said receiving means at both said first fulcrum part and said second fulcrum part when said tremolo arm is inactivated, and said base plate means coming into contact with said receiving means at only said first fulcrum part and said second fulcrum part is separated from said receiving means when said tremolo arm is activated in such a manner that said base plate means is rotated in said one direction of rotation over a stable position in which both of said fulcrum parts are in contact with said receiving means, and said base plate means coming into contact with said receiving means at only said second fulcrum part and said first fulcrum part is separated from said receiving means when said tremolo arm is activated in such a manner that said base plate means is rotated in said another direction of rotation over said stable position.

2. A tremolo device according to claim 1, wherein said base plate means include another plate secured on the under surface of said flat plate, and wherein a front end of said flat plate provides said first fulcrum part and a front end of said another plate provides said second fulcrum part.

3. A tremolo device according to claim 1, wherein a front end of said flat plate is shaped to have an upper edge and a lower edge, and wherein said upper edge provides said first fulcrum part and said lower edge provides said second fulcrum part.

4. A tremolo device according to any one of claims 2 or 3, wherein said receiving means comprises a plurality of screws which are screwed into said guitar body.

5. A tremolo device according to claim 4, wherein each of said screws is provided with two grooves vertically spaced from each other, and wherein said first and second fulcrum parts are engaged with said grooves, respectively.

6. A tremolo device according to any one of claims 2 or 3, wherein said receiving means comprises a plurality of screws screwed into said guitar body, each of said screw being provided with a groove with which said first fulcrum part is engaged, a plurality of fulcrum members arranged on said guitar body at a different level from that of said screws, and each of said fulcrum members being provided with another groove with which said second fulcrum part is engaged.

* * * * *